United States Patent [19]

Czinger

[11] 4,154,167

[45] May 15, 1979

[54] CAM ACTUATED PRINTING SADDLE LOCKUP

[75] Inventor: David B. Czinger, Huntington Beach, Calif.

[73] Assignee: Beach Manufacturing Corporation, Huntington Beach, Calif.

[21] Appl. No.: 785,921

[22] Filed: Apr. 8, 1977

[51] Int. Cl.[2] ..... B41F 27/06

[52] U.S. Cl. ..... 101/415.1; 101/378

[58] Field of Search ..... 101/378, 415.1; 51/365, 51/366, 367, 371, 382, 384, 386

[56] References Cited

U.S. PATENT DOCUMENTS

| | | | |
|---|---|---|---|
| 1,508,951 | 9/1924 | Baker | 101/415.1 |
| 2,475,476 | 7/1949 | Champagne | 51/384 |
| 2,577,073 | 12/1951 | Dell | 101/415.1 |
| 3,017,830 | 1/1962 | Penner | 101/415.1 |
| 3,696,744 | 10/1972 | Etchell | 101/415.1 |
| 3,994,224 | 11/1976 | Hill | 101/415.1 |
| 4,061,087 | 12/1977 | Hill | 101/415.1 |

*Primary Examiner*—William Pieprz

*Attorney, Agent, or Firm*—Fulwider, Patton, Rieber, Lee & Utecht

[57] ABSTRACT

There is disclosed, a printing saddle lockup including a saddle mounted on a rotary printing cylinder and having a floating biasing bar disposed at one edge thereof. A recess is formed in the cylinder beneath the biasing bar and a cavity is formed in such bar over the recess and receives a rotary cam having an eccentric peg projecting downwardly therefrom to engage a hair pin shaped spring projecting longitudinally into such recess, such that rotation of the cam in one direction contacts such peg with one leg of such spring such that continued rotation urges the biasing bar in one circumferential direction on the cylinder and rotation of such cam in the opposite direction contacts such peg with the opposite leg of such spring whereby further rotation of such cam urges such biasing bar in the opposite circumferential direction.

11 Claims, 14 Drawing Figures

FIG. 1
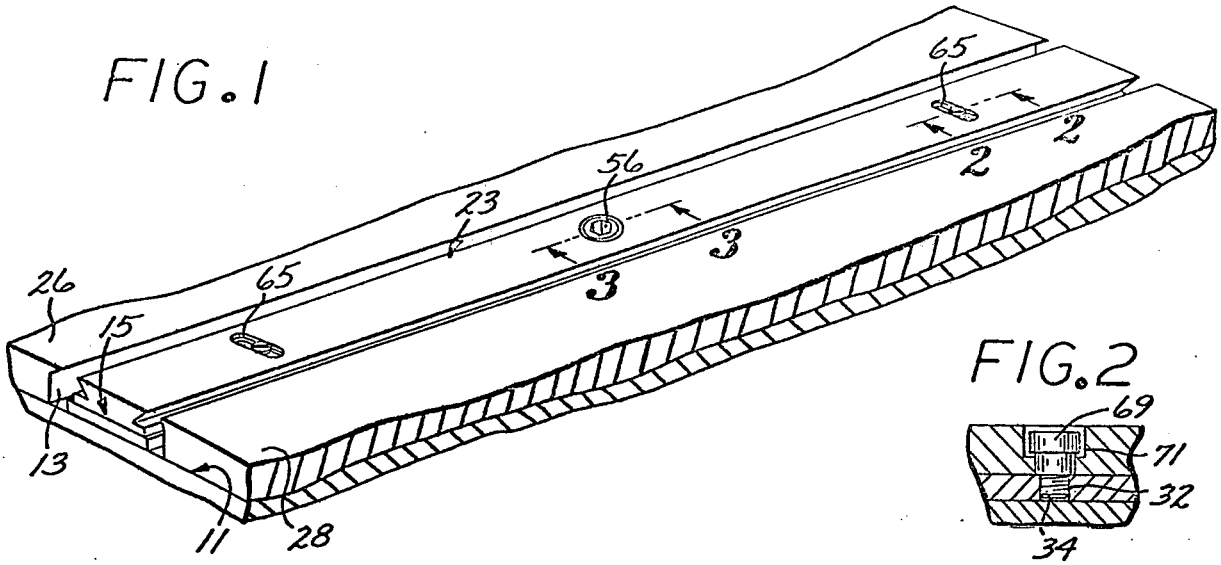
FIG. 2
FIG. 3
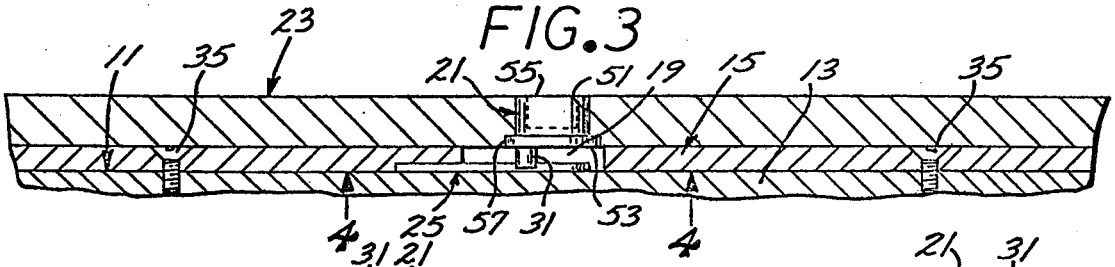
FIG. 4
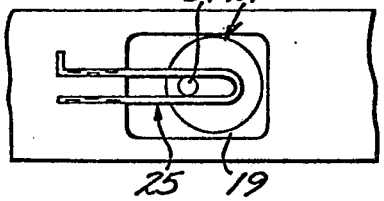
FIG. 5
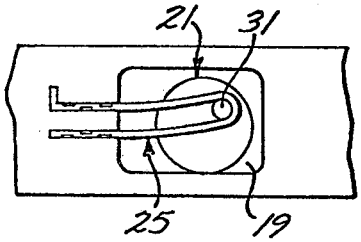
FIG. 7
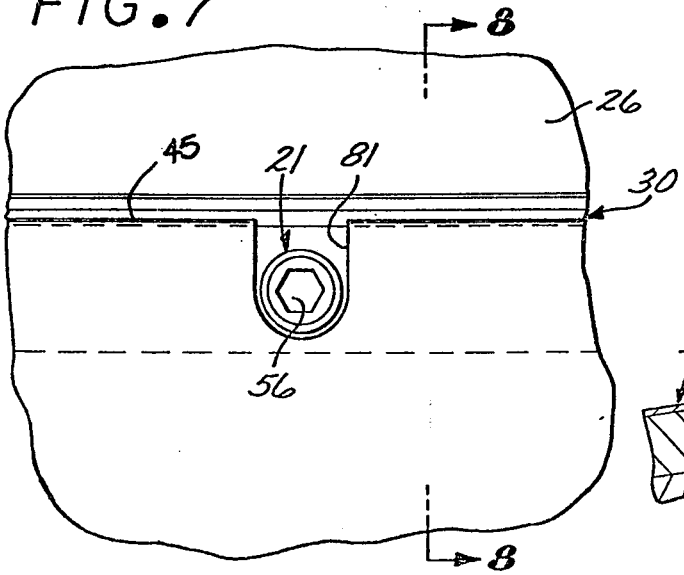
FIG. 6
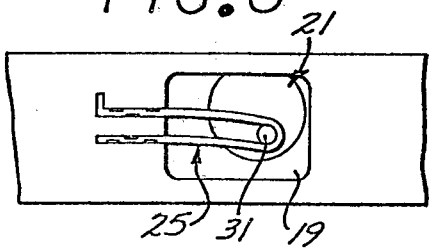
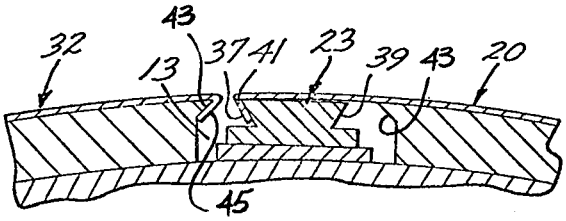
FIG. 8

FIG. 9
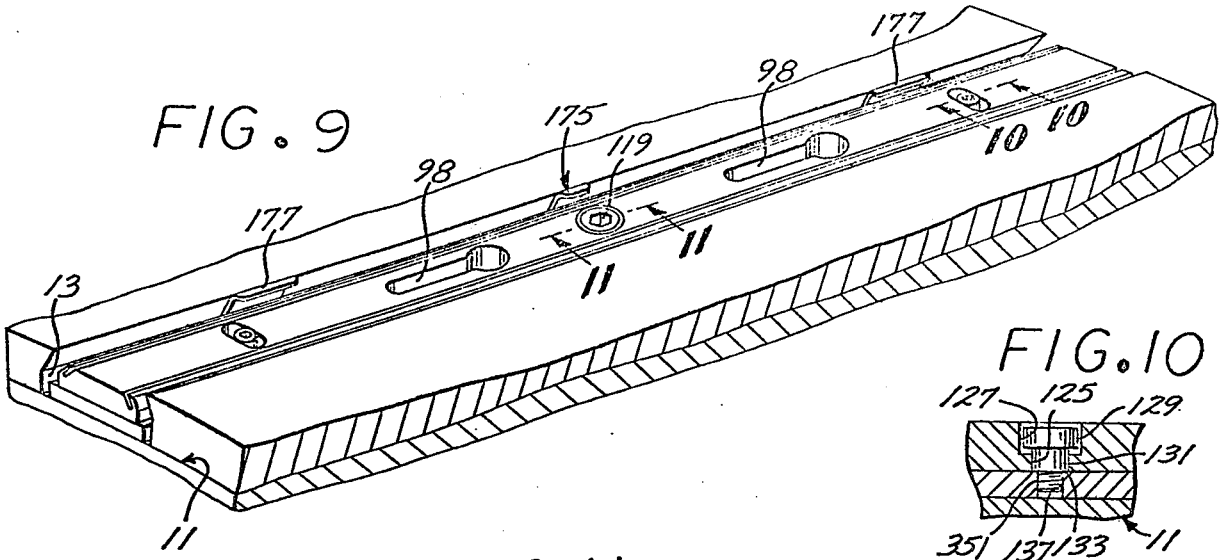
FIG. 10
FIG. 11
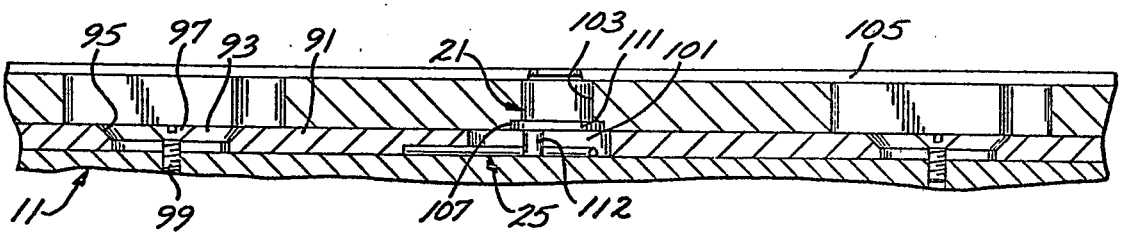
FIG. 14
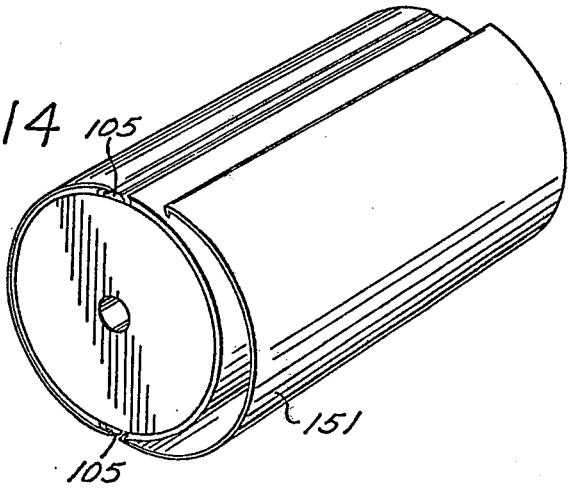
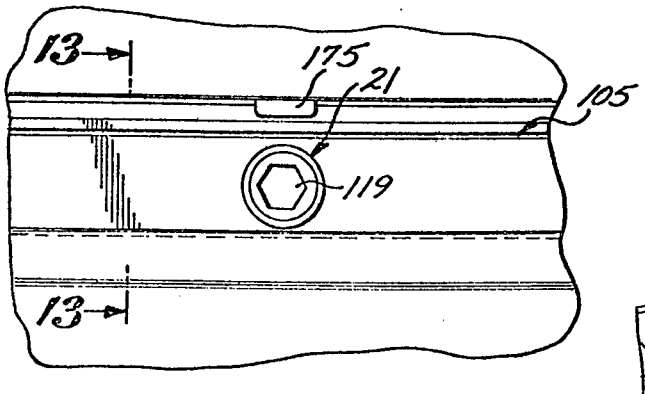
FIG. 12
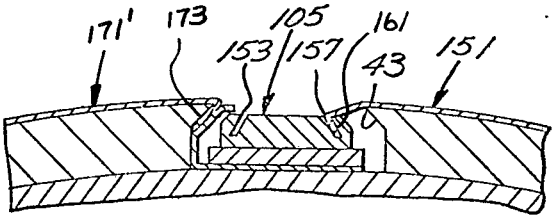
FIG. 13

CAM ACTUATED PRINTING SADDLE LOCKUP

BACKGROUND OF THE INVENTION

1. Field of the Invention

The cam actuated printing saddle lockup of the present invention relates to a device for locking the biasing bar of a printing saddle in its retracted position during loading thereof.

2. Description of the Prior Art

Numerous different types of biasing bar printing saddle lockup mechanisms have been proposed for conveniently locking the biasing bar in its retracted position during loading of a printing drum. My previous U.S. Pat. No. 3,943,852 shows device of this type which incorporates a self-contained locking ball arrangement wherein retraction of the bar causes a pair of latching balls to lock it in its retracted position to hold such bar retracted until such time as a release plunger is depressed to release the balls. This arrangement, while giving satisfactory performance, contemplates the use of relatively expensive plunger spring and ball arrangements necessitating rather elaborate and expensive assembly time.

U.S. Pat. No. 3,727,551 also shows a lockup arrangement wherein a rotatable shaft is mounted within the printing drum for bias to opposite sides of an over the center position for automatically retraction and locking of the shaft. This arrangement, while giving a degree of satisfactory performance, is extremely expensive to manufacture and assemble.

SUMMARY OF THE INVENTION

The cam actuated printing saddle lockup of the present invention is characterized by a cam carried in a cavity formed in a biasing bar for rotation about its own axis and formed with an eccentric pin which engages with a longitudinally extending bias spring mounted from the saddle and projecting into such cavity for engagement with the pin to enable the cam to be rotated in one direction to urge the sliding bar transversely in one transverse direction towards its retracted position and when the pin passes over the center position, the cam will be locked in its retracted position biasing the bar to its retracted position for convenient mounting of a printing plate.

BRIEF DESCRIPTION OF THE DRAWINGS

FIG. 1 is a broken perspective view of a printing saddle incorporating the cam actuated lockup mechanism of the present invention;

FIG. 2 is a longitudinal sectional view taken along the lines 2—2 of FIG. 1;

FIG. 3 is a longitudinal sectional view, in an enlarged scale, take along the lines 3—3 of FIG. 1;

FIG. 4 is a longitudinal sectional view taken along the lines 4—4 of FIG. 3;

FIGS. 5 and 6 are longitudinal sectional views similar to FIG. 4 but showing a cam in different position;

FIG. 7 is a top plan view, in an enlarged scale, of the printing saddle shown in FIG. 1 but with a printing plate being mounted thereon;

FIG. 8 is a transverse sectional view, in an enlarged scale, taken along the lines 8—8 of FIG. 7;

FIG. 9 is a partial perspective view of a second embodiment of the cam actuated printing saddle lockup of the present invention;

FIG. 10 is a longitudinal sectional view, in a enlarged scale, taken along the lines 10—10 of FIG. 9;

FIG. 11 is a longitudinal sectional view, in an enlarged scale, taken along the lines 11—11 of FIG. 9;

FIG. 12 is a detailed plan view of the central portion, in an enlarged scale, of the central portion of the cam actuator lockup mechanism shown in FIG. 9;

FIG. 13 is a transverse sectional view, in an enlarged scale, taken along the lines 13—13 of FIG. 9; and FIG. 14 is a perspective view, in reduced scale, showing a printing plate being mounted on the cam actuated lockup shown in FIG. 9.

DESCRIPTION OF THE PREFERRED EMBODIMENTS

Referring to FIG. 1, the cam actuated printing saddle lockup of the present invention includes, generally, a rotary printing cylinder 11 formed on its diametrical opposite sides with longitudinally extending radially outwardly opening grooves 13. A longitudinally extending base plate, generally designated 15, is mounted on the bottom wall of the grooves 13 and is formed centrally with a longitudinal slot forming a spring recess 19 (FIG. 4) over which is disposed a cylindrical rotary cam, generally designated 21 (FIG. 3), carried from a longitudinally extending biasing bar, generally designated 23. A hair pin shaped biasing spring, generally designated 25 projects longitudinally across the spring recess 19 and straddles an eccentric slide pin 31 projecting from the cam 21 such that rotation of such cam in a clockwise direction as viewed in FIG. 1 will cause the biasing bar to be urged toward the viewer as viewed in FIG. 1 under the influence of the spring 25 (FIG. 6) and the free closed end of such spring will flex enabling the slide pin 31 to pass over the center position to engage the closed end of such spring to limit further rotation of the cam as viewed in FIG. 6 thus locking the bar in its retracted position for convenient loading of a flexible printing plate 30 on such saddle.

Referring to FIG. 1, the cylinder 11 is formed in its diametrically opposite sides with the generally rectangular in cross section grooves 13 extending the full length of the cylinder and being opened on their radially outer sides. Referring to FIG. 3, the base plate 15 is in the form of a strip sandwiched between the passing bar 23 and bottom wall of the slot 13 and is formed centrally with a rectangular window forming the spring recess 19. Obviously, such recess 19 may conveniently be formed directly in the bottom wall of the groove 13 or could even be formed directly in the underside of the biasing bar 23. However, for economy of manufacture, the base plate 15 is provided for ease of assembly and economy in machining. The base plate 15 itself is secured to the cylinder 11 by means of mounting screws 35 (FIG. 3).

The biasing bar is in the form of an elongated generally rectangular shaped metallic bar having its opposite sides undercut to form oppositely facing dovetail shaped inclined lips 37 and 39 for engagement with ends 41 of the printing plate 30 (FIG. 8). The opposite sides of the groove 13 are also cut back to form inclined ledges 43 over which hooks 45 formed in the opposite extremity of the plate 30 are hooked.

Referring to FIG. 3, the biasing bar 23 is formed centrally with a bore 51 which overlies the recess 19 and is open on its opposite extremities. The inner end of the bore 51 is enlarged in diameter to form a cam socket 53 opening directly into the recess 19.

The cam 21 is in the form of a rotary cylinder 55 (FIG. 3) received rotatably in the bore 51 and is enlarged in diameter at its lower extremities to form a circular cam disc 57 received in such socket 53. The eccentric drive pin projects axially from the cam disc 57 and is slidably received between the opposite legs of the hair pin shaped spring 25 to couple the cam and spring together.

The spring 25 has the base of its opposite legs received in complementary recesses formed in the underside of the base plate 15 (FIGS. 3 and 4) and is diked to such base plate itself to have its closed end projecting cantileverally into such recess. The spring 25 is positioned within such recess 19 to restrict the cam 21 from rotating through a full 360° but has sufficient resiliency to enable the slide pin 31 to be rotated from its neutral position shown in FIG. 4 in a clockwise direction, as viewed in FIGS. 4 and 5, to flex the free extremity thereof to its upper position as viewed in FIG. 4 with the pin 31 at 12 o'clock. As the pin 31 passes 13 o'clock an over-the-center action is produced thus causing the bais spring 25 to urge continued clockwise rotation of the cam 21 to the point where such pin 31 bottoms out on the closed end of the spring 35 thus limiting further clockwise rotation of such pin to thereby maintain the biasing bar 23 biased downwardly, as viewed in FIG. 5. Likewise, when the cam 21 is rotated in its counterclockwise position from the position shown in FIG. 4, as such a slide pin 31 passes through 6 o'clock, it will be further biased by the spring 25 to continue counterclockwise rotation of the cam 21 until such time as the pin 31 again bottoms out on the closed end of the spring 25 as viewed in FIG. 6.

Referring to FIG. 1, the biasing bar 23 is formed at its opposite extremity projecting through transverse guide slots 65 and 67 which are reduced in cross section in their lower extremities and receive guide screws 69 (FIG. 2) which have shoulders 71 thereon received within the reduced cross section necks and are formed with heads which retain the biasing bar 23 in position while accommodating transverse sliding thereof. The bottom extremities thereof are formed with theaded tips 32 received in internally threaded bores 34 formed in the base plate 15.

Referring to FIGS. 1 and 8, in operation when it is desirable to load a flexible printing plate 30 on a cylinder 11, such cylinder is brought to a stop in the desired position and an Allen wrench or the like inserted in the socket 56 of the cam 21 and such cam rotated clockwise as viewed in FIG. 1, or counterclockwise as used in FIG. 6, to carry the guide pin 31 from its neutral position shown in FIG. 4 downwardly to 6 o'clock thus shifting the bias bar 23 nearer the viewer, as viewed in FIG. 1. As the guide screws 69 bottom out on the pins of the guide slots 65 and 67, further travel of the biasing bar 65 will be restricted thus causing the free extremity of the spring 25 to be flexed downwardly as viewed in FIG. 6 during the last 20° of rotation prior to such pin reaching its 6 o'clock position. Upon continued rotation of the pin 21, it will pass the 6 o'clock position thus allowing the spring 25 to urge such cam 20 further counterclockwise as viewed in FIG. 6 but, further rotation of such cam will be restricted once such pin 31 bottoms out against the closed extremity of the spring 25 as viewed in FIG. 6. Consequently, the biasing bar 23 will be held in its position shifted to the extreme right as viewed in FIG. 8 to the limit permitted by the guide slots 65 and 67. The cylinder 11 is then ready for loading of a printing plate 30 thereon. This is accomplished by hooking one extremity thereof over the overhang 43 and then flexing the intermediate portion of the plate about the circumference of the cylinder to engage the plate hook 41 with the connecting lip 37.

As best seen in FIG. 7, the plate 30 and hook 45 is cut back centrally to form a key way 81 exposing the Allen wrench socket 56 so the Allen wrench may be reinserted to rotate the cam 21 and its counterclockwise direction as viewed in FIGS. 1 and 7 to thus bring the connecting pin 31 back past its 6 o'clock position thus enabling the spring 25 to continue urging clockwise of the cam 21 as viewed in FIG. 6 to return such slide pin 31 to its neutral position shown in FIG. 4 or to approach such neutral position to the extent permitted by the overall length of the printing plate 30 to thus cause the spring 25 to maintain such plate 30 biased into firm engagement with the circumference of the cylinder 11. A similar procedure may then be repeated for the plate 32 with the hook 45 being hooked over the lip 43 and the remainder of such plate being bent about the periphery of the cylinder to engage the hook formed on the remote end thereof with a biasing plate similar to the biasing plate 23 but disposed on the diammetrically opposite side of the cylinder 11. The cylinder 11 is then ready for its printing process with the printing plates 30 and 32 held firmly thereon.

When it is subsequently desirable to unload the printing plate 30, the biasing plate 23 may be conveniently and easily retracted by merely rotating the cam 56 again clockwise to retract the biasing bar 23 to the right as viewed in FIG. 8 to free the printing plate hook 41 the connecting lip 37.

It will be appreciated that the opposite sides of the biasing bar 23 are symmetrical and the cam 21 is likewise symmetrical in its action thus enabling the biasing bar 23 to be used to bias the printing plate 30 or 32 in either direction thus enabling such cylinder 11 to be loaded from either side.

The cam actuated lockup mechanism shown in FIGS. 9 through 14 is substantially the same as that shown in FIGS. 1 through 8 and includes a printing saddle 11 having a longitudinal groove 13 formed therein with the opposite edges of such groove defining angular overhangs 45 (FIG. 13).

Mounted in the bottom of such groove 13 is an elongated metallic strip forming a base plate generally designated 91 (FIG. 11) and formed in its opposite longitudinal halves with longitudinally extending adjustment slots 93. The adjustment slots 93 are formed with chamfers 95 for receiving the sloped shoulders of a slotted screw 97 which projects therethrough which is threadably received in a threaded bore 99 formed in the saddle 11.

The base plate 91 is also formed centrally with a rectangular window 101 similar to the window 19 shown in FIG. 4 and has a hairpin-shaped biasing spring 25 projecting therein to and mounted in a manner similar to that shown in FIG. 4.

A cam 21 is likewise mounted in a bore 103 formed in a biasing bar generally designated as 105 overlying the base plate 91 and is formed in its bottom extremity with an enlarged end diameter socket 107 for receipt of an enlarged end diameter cam disc 111 formed on the lower extremity of the disc 21, such disc projecting upwardly and being formed with a reduced in diameter cylindrical cam body 115 which has a hex-shaped Allen wrench socket 119 formed therein (FIG. 9).

The biasing bar 105 is formed intermediately with its opposite halves with a pair of keyway slots 98, the shanks of which overlie the adjustment screw 97 and which are formed with one extremity with an enlarged in cross section circular opening for selective removal of the screws 97 when desired.

The opposite extremities of the biasing bars 105 are formed with transversely extending slide slots 125 (FIG. 10) which are formed in their upper extremities with enlarged in cross section elongated sockets 127 which receive the head 129 of a slide screw, generally designated 131. A slide screw 131 is formed with a reduced in diameter shank 133 which is again reduced in diameter to form a threaded tip 135 threadably received in an internally threaded bore 137 formed in the saddle 11.

The biasing bar 105 is formed to enable the printing plate, generally designated 151, (FIG. 13) to be hooked over the near edge thereof. To this end, such biasing bar has its opposite sides formed with upwardly opening, downwardly and outwardly inclined fastening slots 153 and 157 for selective receipt of the complimentally formed downwardly bent and inclined marginal lip 161 of the printing plate 151. The oppoosite extremity of the printing plate 151 (not shown) is formed with a turned-back lip similar to that shown in FIG. 8 and also to that of the printing plate, generally designated 171, mounted on the opposed half of the printing saddle 11 and depicted in FIG. 13 as the turnedback lip 173.

Referring to FIG. 9, a centering tab, generally designated 175, is mounted centrally along one side of the groove 13 and is formed to compliment the shape of the side of such groove and for receipt in an indexing slot (not shown) formed centrally in the turnback lip 173 (FIG. 13) of the printing plate 171. Mounted adjacent the opposite ends of the slot 13 are a pair of retaining tabs 177 (FIG. 9) behind which are received the lips 173 (FIG. 13) to hold such lips in place during loading of the saddle 11.

To those skilled in the art it will be apparent that with the biasing bar lockup of the present invention, a number of printing plates 151 and 171 (FIG. 13) may be mounted on saddles 11 in end-to-end relationship for printing of various selective strips of newspaper layout and the like. For the particular width of paper being printed and number of printing plates 151 and 171 selected, the longitudinal position of the biasing bar 105 in the groove 13 may easily be adjusted by merely inserting a narrow nose conventional screwdriver in the slots 98 to engage with the slot of the screw 97 to loosen such screw and shift the base plate 91 with the biasing bar 105 thereon in one longitudinal direction or the other. With the biasing bar 105 thus newly positioned, the screw 97 may be tightened to maintain the new setting.

When the printing plate 151 is to be mounted, the lip on the one extremity corresponding with the lip 173 shown in FIG. 13 may be hooked over the overhang 45 disposed diammetrically opposite the biasing bar 105 shown in FIG. 13 and an Allen wrench inserted in the socket 119 (FIG. 9) of the cam 21 and such cam rotated clockwise as viewed in FIG. 9 to carry the eccentric pin 112 to the left with respect to such biasing bar 105 as viewed in FIG. 13 to thus cause the bar itself to be shifted for receipt of the printing plate lip 161 within the fastening notch 157. The cam 21 may then be rotated in the opposite direction to carry such biasing bar 105 back to its central position and move the eccentric pin 112 past its over-the-center position to lock the biasing bar in its plate retaining position. It will be appreciated that the opposite side of the printing saddle 11 may be likewise loaded with the printing plate 171. It is of particular importance that with the construction of the biasing bar 105 having slots 153 and 157 on the opposite sides thereof, the central portion thereof remain uncovered by the plates 151 and 171 thus leaving the cam hex socket 119 open and accessible without the necessity of forming a clearance slot similar to that shown in FIG. 8 in the printing plates 151 and 171.

After the printing operation is completed, the printing plates 151 and 171 (FIG. 13) may conveniently and easily be removed by again retracting the biasing bar 105 to release the turnedback lip 161 from the slot 157. Thereafter, if printing plates of a different length are to be utilized, the longitudinal position of the biasing bar 105 may easily be adjusted by again loosening the adjustment screws 97 (FIG. 11) and shifting the base plate 91 and biasing bar longitudinally in the groove 13. Since the centering tab 175 is carried from the biasing bar 105, it too will be shifted transversely to thus maintain a centered position on such biasing bar.

From the foregoing it will be apparent that the cam actuator lockup mechanism of the present invention provides an extremely foolproof lockup mechanism which is extremely economical to manufacture and convenient to use.

Various modifications and changes may be made with regard to the foregoing detailed description without departing from the spirit of the invention.

I claim:

1. Cam actuated printing cylinder lockup apparatus comprising:

printing cylinder means formed in at least one side with a longitudinal radially outwardly opening groove;

a spring recess formed medially in said groove;

an elongated biasing bar disposed in said groove overlying said recess and formed along one side with plate connector means facing in one direction;

a cam cavity formed in said bar and opening into said recess;

a cam received in said cavity for rotation therein about an axis on the diameter of said saddle;

a spring in said recess having a normal central position with unstable positions to either side thereof along the circumference of said cylinder means; and coupling means disposed off-center on said cam and coupling said cam to said spring and operative upon rotation of said cam a predetermined distance in one angular direction from a mutual position to cooperate with said spring in developing an over-the-center locking action locking said biasing bar urged towards the lateral side of said groove adjacent said connecting means and further operation upon rotation in the opposite angular direction from said mutual position to cooperate with said spring in urging said bar in the opposite direction.

2. Cam actuated printing cylinder lockup apparatus as defined in claim 1, wherein:

said spring is in the form of a U mounted at one extremity of said spring recess and projecting longitudinally thereto; and said cam includes a peg eccentrically located thereon and projecting into spring between the opposite legs thereof.

3. Cam actuated printing cylinder lockup apparatus as defined in claim 1, wherein:

said spring is elongated, having one extremity mounted at one end of said recess and projecting cantileverally longitudinally into said recess; and said coupling means includes slide means eccentrically locagted on said cam and slidably connecting said cam to said spring.

4. Cam actuated printing cylinder lockup apparatus as defined in claim 1, wherein:

said bar is formed with a circular cam socket opening axially into said recess; and said cam is a circular disc received in said socket for rotation therein including an eccentrically disposed coupling slide projecting therefrom to slidably connect with said spring.

5. Cam actuated printing cylinder lockup apparatus as defined in claim 1, wherein:

said bar includes transversely extending guide slots disposed on opposite sides of said cam and guide pins secured on their respective one ends to said saddle and projecting slidably into said slots.

6. Cam actuated printing cylinder lockup apparatus as defined in claim 1, wherein:

said bar is formed with an open-ended bore leading from the radially outer side thereof and expanding on its inner extremity to form an enlarged-in-diameter cam socket; and said cam includes a cylinder received for rotation therein and expanding at its radially inner extremity to form an enlarged-in-diameter disc cam received in said socket.

7. Cam actuated printing cylinder lockup apparatus as defined in claim 1, that includes:

a backing plate interposed between said bar in the bottom of said groove, said bar being formed centrally with a through slot forming said recess; and said spring being in the form of a longitudinally projecting spring mounted on one extremity from one end of said recess.

8. Cam actuated printing cylinder lockup apparatus as defined in claim 1, wherein:

said coupling means includes a slide pin disposed eccentrically on said cam coupled with said spring and operative upon rotation past a predetermined position in a direction opposite said one direction to produce an over-the-center action locking said bar in a position with said spring biasing said bar in a direction away from said connecting means.

9. Cam actuated printing cylinder lockup apparatus as defined in claim 1, wherein:

said coupling means includes a slide pin disposed eccentrically on said cam and projecting into said recess; and said spring is hairpin shaped projecting longitudinally into said recess from one end thereof with the closed end thereof forming a stop engaged by said pin to limit rotation of said cam in said one direction after it has passed its over-the-center position.

10. Cam actuated printing cylinder lockup apparatus as defined in claim 9, wherein:

said biasing bar includes transversely projecting guide slots disposed on opposite sides of said cam and guide means projecting from said cylinder into said slots.

11. Cam actuated printing cylinder lockup apparatus comprising:

a cylinder having saddle means on at least one side thereof and terminating on one longitudinal side to form a recessed longitudinal groove and including printing plate fastening means along the opposite longitudinal side;

an elongated biasing bar in said groove and formed along one side with printing plate connection means;

slide means securing said bar to said cylinder for floating thereof a predetermined distance along the circumferential direction on said cylinder;

a spring recess formed in said cylinder beneath said bar opening outwardly theretowards;

a cam cavity formed in said bar and opening radially inwardly toward said spring recess;

an elongated cantilever spring mounted on one end from said cylinder and projecting into said spring recess in the longitudinal direction of said cylinder and having a central normal position;

coupling means on said cam, offset from the center thereof and slidingly coupled to the free extremity of said spring, said spring being operative in response to rotation of said cam in one direction from a pre-determined normal position to urge said bar in one circumferential direction--said groove and operative in response to rotation of said cam in the opposite direction from said normal position to carry said coupling means past an extreme point of travel in the circumferential direction of said cavity to be carried past an over-the-center position.

* * * * *